US006305284B1

(12) United States Patent
Watanabe et al.

(10) Patent No.: US 6,305,284 B1
(45) Date of Patent: Oct. 23, 2001

(54) METHOD AND APPARATUS FOR MAKING AN OFFSET PRINTING PLATE

(75) Inventors: Miyoshi Watanabe; Masami Mochizuki, both of Fuji (JP)

(73) Assignee: Asahi Kasei Kabushiki Kaisha (JP)

( * ) Notice: Subject to any disclaimer, the term of this patent is extended or adjusted under 35 U.S.C. 154(b) by 0 days.

(21) Appl. No.: 09/485,775

(22) PCT Filed: Aug. 14, 1998

(86) PCT No.: PCT/JP98/03634

§ 371 Date: Feb. 15, 2000

§ 102(e) Date: Feb. 15, 2000

(87) PCT Pub. No.: WO99/08872

PCT Pub. Date: Feb. 25, 1999

(30) Foreign Application Priority Data

Aug. 15, 1997 (JP) ..... 9-220435
Sep. 12, 1997 (JP) ..... 9-248666

(51) Int. Cl.[7] ..... B41M 5/00; B41J 2/315
(52) U.S. Cl. ..... 101/463.1; 400/120.01
(58) Field of Search ..... 101/463.1; 400/120.01

(56) References Cited

U.S. PATENT DOCUMENTS 5,661,566 * 8/1997 Gerber ..... 358/304
5,856,061 * 1/1999 Patel et al. ..... 430/201
5,934,195 * 8/1999 Rinke et al. ..... 101/401.1
5,976,763 * 11/1999 Roberts et al. ..... 430/286.1

FOREIGN PATENT DOCUMENTS 0 803 771 A * 10/1997 (EP) .
839 647 A * 5/1998 (EP) .
51-46138 4/1975 (JP) .
56-58868 5/1981 (JP) .
60-203071 10/1985 (JP) .
61-48982 3/1986 (JP) .
2-75534 3/1990 (JP) .
6-186750 7/1994 (JP) .
07001849A 1/1995 (JP) .

* cited by examiner

*Primary Examiner*—Ren Yan
*Assistant Examiner*—Charles H. Nolan, Jr.
(74) *Attorney, Agent, or Firm*—Pennie & Edmonds LLP

(57) ABSTRACT

The present invention concerns a plate making method of forming an image on a heat sensitive blank plate by a multichannel method using a plate making apparatus of an outer surface cylinder scanning type. A blank plate (400) is secured to the outer circumferential surface of a hollow cylinder (131). A laser beam (800) is irradiated from an optical head (150) onto the blank plate (400). The laser beam (800) is a beam group consisting of a plurality of infrared laser beams arranged in a line.

14 Claims, 9 Drawing Sheets

METHOD AND APPARATUS FOR MAKING AN OFFSET PRINTING PLATE

TECHNICAL FIELD

The present invention concerns a method of making a heat sensitive type offset printing plate and a manufacturing apparatus capable of easily practicing the method.

BACKGROUND ART

An apparatus adapted to irradiate a laser beam selectively on a sensitive material based on an image recording signal thereby forming an image has been known so far as a film plotter or an image setter. For example, Japanese Patent Unexamined Publication No. 60-203071 discloses a laser plate making apparatus of forming an image by a plurality of laser beams.

On the other hand, along with popularization of computers or development of network techniques typically represented by internets in recent years, a CTP (computer to plate) system of directly making a plate for offset printing from digital image data edited on a computer not by way of a negative film or a positive film has been enabled. Then, the CTP system has attracted attention as a substitute for a PS (pre-sensitized) plate system using a film, which is predominant in offset printing at present.

A system already put to practical use as a plate making system of an offset printing plate used for the CTP system is a print making system using photosensitive materials such as an OPC (organic photo-semiconductor), a silver salt, a hybrid material of a silver salt and a photopolymer and a highly sensitive photopolymer as a blank plate. However, it is necessary for the print making system described above that the blank plate has to be handled in a dark room like that existent PS print systems. Further, the plate making systems described above requires a developing step after the image drawing step to the blank plate like that the existent PS plate system and, therefore, involves a problem for discarding treatment of a liquid developer or the like.

On the contrary, a CTP plate making system using a heat sensitive type blank plate having a response region in an infrared region, the blank plate can be handled in a light room. Further, a great amount of heat energy is charged in an image forming step by a laser beam in this system, thereby an image is formed by thermally converting a portion, to which an image is formed, of a heat sensitive layer from hydrophilic to oleophilic property, so it requires no developing step. Accordingly, such a heat sensitive type CTP system has been noted as a CTP system in the next generation.

Generally, plate making apparatus used for the CTP system are broadly classified, depending on the difference of scanning system, into three types of an outer surface cylinder scanning system, an inner surface cylinder scanning system and a planer scanning system. A laser plate making apparatus of the outer surface scanning system is disclosed, for example, in Japanese Patent Examined Publication No. 51-46138.

As the plate making apparatus used for photosensitive blank plates, a plate making apparatus of an inner surface cylinder scanning system of securing a blank plate to a cylinder inner surface and scanning a laser beam by a rotational end face mirror has been utilized generally, since this can conduct a high speed scanning and also easily cope with different sizes of blank plates. However, the inner surface cylinder scanning type plate making apparatus is not suitable as a plate making apparatus for heat sensitive type blank plates with the reason described below.

That is, since a heat sensitive type blank plate generally has a sensitivity lower by about three digits compared with a photosensitive blank plate, when the inner surface cylinder scanning system is adopted, it requires an expensive solid laser of excellent beam characteristics, for example, an Nd-YAG laser capable of providing an extremely high output energy and having a long focal distance. However, since the sensitive wavelength region of usable blank plates is restricted to 1064 nm as an emitting wavelength of an Nd-YAG laser, the degree of freedom for the design of the blank plate is lowered in the inner surface cylinder scanning type plate making apparatus using the Nd-YAG laser as an image forming laser.

On the contrary, a semiconductor laser having a central light emission wavelength region near 750–880 nm is inexpensive compared with the Nd-YAG laser. Accordingly, use of the semiconductor layer for the image forming laser is preferred in order to reduce the apparatus cost of the heat sensitive type CTP system. However, since no long focal distance can be available in the semiconductor laser in view of beam characteristics, it is difficult to adopt the inner surface cylinder scanning system in the plate making apparatus using the semiconductor laser.

Accordingly, in the plate making apparatus using the semiconductor laser, an outer surface cylinder scanning system, that is, a system of winding a blank plate around the outer surface of a cylinder, and irradiating a laser beam to the blank plate from an optical head disposed near the cylinder outer surface is adopted. The plate making apparatus of this type is adapted, for example, such that a laser beam irradiated from a semiconductor laser is transmitted through an optical fiber and introduced to the optical system of an optical head disposed near the cylinder outer surface and a laser beam focused by an objective lens at the top end of the optical system to the blank plate at the cylinder outer surface.

In the plate making apparatus of the outer surface cylinder scanning system described above, with an aim of increasing the plate making speed, an image is formed by a so-called multi-channel system of using a plurality of semiconductor lasers to increase the number of scanning lines per one rotation of the cylinder.

Then, in a general multi channel system plate making apparatus, a plurality of laser beams are arranged each at an equal interval in line and the beams are formed into a group of beams parallel with each other and the beam group is introduced to a set of optical systems.

However, when an image is formed by a plurality of infrared laser beams arranged in line, heat of infrared rays is absorbed in the heat sensitive layer, as well as a great amount of heat is also generated by chemical reaction in the heat sensitive layer. Then, the heat diffuses to the periphery by heat conduction while elevating the temperature of the blank plate. Accordingly, the temperature of the image area of the blank plate formed with an image by a beam situated at the center of the line is higher compared with that in the image region of the blank plate formed with an image by a beam situated on the end of the line.

As described above, when an image is formed by a plurality of infrared laser beams disposed in line to the heat sensitive blank plate to be formed with images by thermal reaction, since a temperature distribution is caused to the blank plate upon image formation, it is difficult to form an image uniformly over the entire image formation region.

That is, there is a room for the improvement of the image quality of the printing plate obtained by this method.

On the other hand, in the process color printing, a color image is separated into that of four colors, namely, Y (yellow), M (magenta), C (cyan) and K (black), and a plate for each color is made, and each of images is printed with an ink of a corresponding color by using the four plates. Then, color printed matters of good quality can be obtained by overlapping images printed by the four plates with inks of different colors on an exact position of paper. Positional alignment for each of the plates in a printing machine is carried out by disposing one side as a reference to each of the plates and aligning the sides to each other. Accordingly, also in the plate making, an image has to be formed at an accurate position with the side being as a reference.

However, the plate making apparatus of the outer surface cylinder scanning system in the prior art still has a room for the improvement in view of convenient and accurate positioning upon attaching the blank plate to the cylinder.

Further, Japanese Patent Unexamined Publication No. 7-1849 discloses a material for forming a heat sensitive layer constituting a heat sensitive type blank plate, which contains microcapsules containing an oleophilic ingredient in the inside and destroyed by heat, hydrophilic binder polymer having functional groups capable of three dimensional cross linking and functional groups capable of reacting with the oleophilic ingredient, and photoreaction initiator for initiating three dimensional cross linking reaction of the hydrophilic binder polymer. However, the printing plate made by the existent method using the heat sensitive blank plate having the material as a heat sensitive layer is insufficient in the printing resistance for an image area and still leaves a room for improvement in the printing quality of the obtained printing plate.

The present invention has been accomplished taking notice on the problems in the prior art described above, and it is a subject thereof to remarkably improve the quality of the image to be formed and the printing quality in the image area, upon making the heat sensitive blank plate into a printing plate by the outer surface cylinder scanning system plate making apparatus and, further, enable to accurately position images of four colors by a convenient method in a short period of time upon process color printing.

DISCLOSURE OF THE INVENTION

In order to solve the foregoing subject, the present invention provides a method of making an offset printing plate comprising a blank plate attaching step of winding a plate-shaped blank plate having a heat sensitive layer to which an image is formed thermally on a support around the outer circumferential surface of a cylinder with the heat sensitive layer being directed outward, thereby making the blank plate rotatable integrally with the cylinder, and an image forming step of irradiating a group of beams comprising a plurality of infrared laser beams arranged in line to the blank plate on the outer circumferential surface of the cylinder based on an image forming signal while rotating the cylinder, thereby forming an image in accordance with the image forming signal to the heat sensitive layer of the blank plate, wherein irradiation conditions for a plurality of infrared laser beams constituting the group of beams are set such that the temperature of the blank plate is uniform in a region in which an image is formed at once by the group of beams in line in the image forming step.

According to this method, since the temperature of the blank plate is made uniform in the region in which an image is formed at once by the group of beams in line, the temperature of the blank plate is made uniform over the entire region in which the image is formed in one rotation of the cylinder. Accordingly, image formation by a uniform heat sensitive reaction is conducted for the entire surface of the heat sensitive layer of the blank plate, for example, by repeating the movement of the group of beams in line in the direction of the rotational axis of the cylinder on every one rotation of the cylinder. This can outstandingly improve the image quality of the obtained printing plate.

The blank plate attaching step in the method according to the present invention preferably has a step of securing the top end of the blank plate to the circumferential surface of the cylinder by a clamp mechanism, in which positioning is conducted by utilizing one side at the top end of the blank plate upon securing by the clamp mechanism and the blank plate is attached while keeping the positioned state.

According to this method, since the blank plate has been positioned by utilizing one side at the top end of the blank plate before the image forming step, an image is formed at an accurate position relative to one side as a reference of the blank plate in the image forming step. This enables to conduct positioning also in the process color printing by a convenient operation and accurately.

After the image forming step in the method of the present invention, a post treating step of irradiating UV-rays at a wavelength of 200 to 400 nm to the heat sensitive layer of the blank plate is preferably conducted. In this method, printing quality such as printing resistance of an image area can be improved outstandingly by conducting the post treatment step of UV-ray irradiation.

The present invention further provides a method of making an offset printing plate, comprising a blank plate attaching step of winding a plate-shaped blank plate having a heat sensitive layer to which an image is formed thermally on a support around the outer circumferential surface of a cylinder with the heat sensitive layer being directed outward, thereby making the blank plate rotatable integrally with the cylinder, and an image forming step of irradiating infrared laser beams to the blank plate on the outer circumferential surface of the cylinder based on an image forming signal while rotating the cylinder, thereby forming an image in accordance with the image forming signal to the heat sensitive layer of the blank plate, wherein a post treating step of irradiating UV-rays at a wavelength of 200 to 400 nm to the heat sensitive layer of the blank plate is conducted after the image forming step.

According to this method, printing quality such as printing resistance of an image area is outstandingly improved by applying the post treating step of UV ray irradiation.

In a case where the heat sensitive layer contains microcapsules containing an oleophilic ingredient in the inside and thermally destroyed, hydrophilic binder polymer having functional groups capable of three dimensional cross linking and functional groups capable of reacting with the oleophilic ingredient, and photoreaction initiator for initiating the three dimensional cross-linking reaction of the hydrophilic binder polymer as described in Japanese Published Unexamined Patent Application Hei 7-1849, the hydrophilic binder polymer can be three dimensionally cross linked by the post treating step. This can modify the surface of the blank plate just after the image forming step to remarkably improve the printing quality such as ink receptibility and transferability, reproducibility of fine lines or mesh dots, or printing resistance.

Further, the present invention provides an apparatus for making an offset printing plate, comprising a cylinder having a rotational mechanism, a blank plate attaching mechanism for winding and securing a plate-shaped heat sensitive type blank plate (having a heat sensitive layer on a support) to the outer circumferential surface of the cylinder, a cassette for keeping a plurality of blank plates, a blank plate supply mechanism of taking out blank plates from the cassette and directing them to the cylinder, a laser generation device for generating a plurality of infrared laser beams in line, an irradiation condition setting device for setting irradiation condition (intensity or irradiation time) on each of infrared laser beams based on an image forming signal and the position in the line, a laser irradiation head (hereinafter also referred to as "optical head") having an optical system for focusing a plurality of laser beams irradiated from the laser generation device to the blank plate wound around the outer circumferential surface of the cylinder, and a head moving mechanism for linearly moving the laser irradiation head along a line opposing in parallel with the rotational axis of the cylinder at a position spaced apart by a predetermined distance from the cylinder.

The group of the laser beams in line to be generated from the laser generation device may be laser beams disposed only by one in the lateral direction of the line, or it may be disposed in plurality. Accordingly, the laser generation device can be obtained, for example, by providing a plurality of optical fibers coupled to semiconductor lasers and arranging each of the optical fibers in one direction at an equal distance, or arranging them both in the longitudinal direction and the lateral direction of the line each by a predetermined number at an equal distance.

In this plate making apparatus, the plate-shaped heat sensitive blank plate is wound and secured to the outer circumferential surface of the cylinder with a heat sensitive layer being directed outward, the cylinder is rotated in this state and the laser generation device is operated, and a laser beam is irradiated over the entire surface of the blank plate of the outer circumferential surface of the cylinder by repeating movement of the irradiation head each by a predetermined amount by the head moving mechanism, on every one rotation of the cylinder for example. Further, by the setting of the irradiation condition setting device, an image in accordance with the image forming signal is formed to the heat sensitive layer of the blank plate.

Particularly, when the irradiation condition of each of the infrared laser beams is set, for example, such that the irradiation energy is low for the laser beam at the center of the line and the irradiation energy is high for the laser beam on the ends of the line based on the position in the line, the temperature of the blank plate can be made uniform within a region in which an image is formed at once by a group of laser beams arranged in line.

In the plate making apparatus according to the present invention, preferably the blank plate supply mechanism has a conveying device for conveying a blank plate from the laterally direction to the cylinder, the blank plate attaching mechanism has a clamp mechanism for securing the top end of the blank plate conveyed by the conveying device to the circumferential surface of the cylinder, and the clamp mechanism has a positioning surface for being touched by the top end face of the blank plate. With such a constitution, positioning can be conducted easily by utilizing one side at the top end of the blank plate upon securing the top end of the blank plate by the clamp mechanism.

The plate making apparatus according to the present invention preferably has a UV-ray irradiation device for irradiating UV-rays at a wavelength of 200 to 400 nm to the heat sensitive layer of the blank plate and a blank plate moving mechanism for detaching the blank plate from the cylinder and directing the same to the UV-ray irradiation device.

Furthermore, the present invention provides an apparatus for making an offset printing plate, comprising a cylinder of a structure capable of winding and securing a plate-shaped blank plate to the outer circumferential surface thereof, a rotational mechanism for the cylinder, a laser generation device for generating a laser beam in an infrared region based on an image forming signal, a laser irradiation head having an optical system for focusing the laser beam from the laser generation device to the blank plate on the outer circumferential surface of the cylinder, a head moving mechanism for moving the irradiation head along a line opposing in parallel with the rotational axis of the cylinder at a position spaced apart by a predetermined distance from the cylinder, a UV-ray irradiation device for irradiating UV-rays at a wavelength of 200 to 400 nm to the heat sensitive layer of the blank plate and a blank plate moving mechanism for detaching the blank plate from the cylinder and directing the same to the UV-ray irradiation device.

According to this apparatus, the laser beam is irradiated over the entire surface of the blank plate on the outer circumferential surface of the cylinder after winding and securing the plate-shaped blank plate having a heat sensitive layer on a support to the outer circumferential surface of the cylinder with the heat sensitive layer being directed outward, and by rotating the cylinder in this state and operating the laser generation device, and repeating movement of the irradiation head by a predetermined amount by the head moving mechanism, on one rotation of the cylinder, for example. This can form an image in accordance with the image forming signal to the heat sensitive layer of the blank plate. Subsequently, the blank plate is detached by the blank plate moving mechanism from the cylinder and directed to the UV-ray irradiation device, and the heat sensitive layer thereof is irradiated with UV-rays at a wavelength of 200 to 400 nm.

In the plate making apparatus according to the present invention, the apparatus having the UV-ray irradiation device and the blank plate moving mechanism is suitable to a case in which the heat sensitive layer contains microcapsules containing an oleophilic ingredient in the inside and destroyed thermally, hydrophilic binder polymer having functional groups capable of three dimensional cross linking and functional groups capable of reacting with the oleophilic ingredient, and photoreaction initiator for initiating three dimensional cross linking reaction of the hydrophilic binder polymer. Further, the print making apparatus preferably has a blank plate attaching mechanism of winding a plate-shaped blank plate to the outer circumferential surface of the cylinder and capable of rotating the same integrally therewith.

As a light source of the post treating device, a fluorescent lamp having wavelength peaks in emission wavelength regions of 300 to 400 nm and 360 to 370 nm (chemical lamp) or a fluorescent lamp having wavelength peaks in emission wavelength regions of 200 to 300 nm and 250 to 255 nm (sterilizing lamp) can be used. Further, the chemical lamp and the sterilizing lamp can be used together.

As the light source for the post-treating device, a high pressure mercury lamp having an emission wavelength region of 200 to 500 nm, superhigh pressure mercury lamp, or metal halide lamp can be used.

When the high pressure mercury lamp, superhigh pressure mercury lamp, or metal halide lamp is used as the light source for the post-treating device, a cold mirror or a heat ray absorption glass is preferably disposed each alone or in combination. Further, if a blank plate is deteriorated by UV-rays in a specific wavelength region, a filter for cutting UV-rays in such a wavelength region is preferably disposed.

When the high pressure mercury lamp, superhigh pressure mercury lamp or metal halide lamp is used as the light source for the post-treating device, the light source is preferably inserted in a water-cooled blue filter jacket tube for cutting a wavelength at 450 nm or higher.

As the light source for the post-treating device, a UV ray laser having an oscillation wavelength in an ultraviolet region such as an He-Cd may also be used.

Further, the post treating device is preferably constituted such that UV-rays can be irradiated to the blank plate in a state wound around the cylinder without attaching the blank plate from the cylinder. The constitution for this purpose can include, for example, an arrangement of disposing the light source to the periphery of the cylinder or transmission of UV-rays through optical fibers from the UV-ray generation device to the outer circumference of the cylinder.

In a case of using optical fibers for the irradiation of UV-rays, it is preferably constituted such that the top ends of the optical fibers for irradiation of UV-rays are disposed together on a moving stage for attaching an optical head that irradiates infrared beams for image formation, the top ends of the optical fibers for irradiation of UV-rays are arranged at a position behind the optical head along the moving direction of the stage upon forming the image, so that UV-rays can be irradiated to the surface of the blank plate simultaneously with image formation by the infrared beams.

In the print making apparatus according to the present invention, the image forming width of the laser beam by the optical head is determined depending on the number of the laser beams and resolution of the image formed to the blank plate, and the moving amount of the optical head is set in accordance with the image forming width.

Further, it is preferably constituted such that the size of the blank plate in circumferential direction is made smaller than the cylinder circumference (up to about 70 to 80% of the cylinder circumference), to provide a marginal portion not mounted with the blank plate to the outer circumferential surface of the cylinder and the optical head is moved while it is opposed to the marginal portion.

As an image forming signal used for a CTP system, a digital image recording signal (bit map data) formed, for example, by applying an RIP (Raster Image Processor) process to an image data edited by a DTP (Desk Top Publishing) of a computer or an electronic composing machine is utilized.

The bit map data is, for example, compressed optionally in an RIP section, received by a control computer and stored in a main memory, and the compressed bit map data is optionally restored into an original data, and sent to a line memory of electronic control device. Further, a rotary encoder is disposed on the axis of the cylinder and the data of the rotational angle measured by the rotary encoder are sequentially taken into the electronic control device.

Then, the coordinate for the start position of the laser irradiation to the blank plate wound around the cylinder is calculated on real time and, at the same time, a coordinate for the completion position of the laser irradiation is calculated from an optimal irradiation time on every laser within a range of a maximum laser irradiation time induced from the inter-pixel pitch determined depending on a desired resolution and the rotational circumferential speed of the cylinder. Then, the coordinate for the start position of the laser irradiation and the coordinate for the completion position of irradiation are superimposed on the image signal of the line memory to prepare a control signal and the laser generation device is controlled by the control signal.

Further, an infrared ray intensity measuring sensor is disposed on an optical path of the semiconductor laser beam to sample a laser intensity upon actuation of the plate making apparatus or at an appropriate timing and the laser intensity data is taken into the control computer. Further, the data is calculated in comparison with a previously registered set value on each lasers and a driving input current for the semiconductor laser is controlled in accordance with the input current and the output intensity characteristic of the semiconductor laser to keep the intensity of each laser beam irradiated to the blank plate always at a predetermined value.

Alternatively, a photosensor is disposed near the opposing side of the semiconductor oscillator on the side of the emitter (the laser beam emitting port) and the laser intensity is sampled on real time upon oscillation of the semiconductor laser. Then, the intensity data is taken into the control computer and the same calculation as described above is conducted by an automatic calculation function to control the input current for driving the semiconductor laser to keep the intensity of each laser beam irradiated to the blank plate always at a predetermined value.

Since the focal position of the laser beam is displaced subtly from the surface of the blank plate on the outer circumferential surface of the cylinder depending on the difference of the thickness of the blank plate, circularity of the outer surface of the cylinder, deflection of the cylinder during rotation, or thermal expansion or thermal shrinkage of the cylinder or the like caused by the change of the atmospheric temperature in the plate making apparatus, the optical system preferably comprises an automatic focus correction mechanism adapted to move an objective lens in a direction vertical to the blank plate to always focus the laser beam at the surface of the blank plate.

The infrared laser constituting the laser generation device is preferably a semiconductor laser emitting an infrared rays at an emission wavelength of 750 to 880 nm and at the maximum power of 100 mW to 20 W, and the semiconductor laser is preferably used under PWM (Pulse Width Modulation) by directly controlling the input current at a modulation speed within a range from 0.1 to 10 Mbit/sec.

The laser beam from the laser generation device has preferably a constitution to be transmitted through optical fibers to the optical head.

The optical system is preferably incorporated with a zoom mechanism capable of automatically changing the optical magnification factor in accordance with a desired resolution. Further, the optical system is preferably constituted such that the beam spot diameter focused to the blank plate on the outer circumferential surface of the cylinder is from 5 to 50 $\mu$m.

An air blow and a vacuum suction mechanism are preferably disposed near the top end of the optical head with an aim of removing mists evaporated and scattered from the surface of the blank plate by thermal reaction in the course of image formation by the irradiation of the laser beams to the blank plate wound around the cylinder.

The plate making apparatus is preferably constituted to blow cleaning air into the plate making apparatus to keep the inside of the apparatus in a pressurized state by the provision of the air blower and the air filter.

Further, the rotational speed of the cylinder is preferably from 50 to 3000 rpm.

BEST MODE FOR PRACTICING THE INVENTION

First Embodiment

A first embodiment of the plate making apparatus according to the present invention is to be explained with reference to FIGS. 1 to 6.

Figure 1:
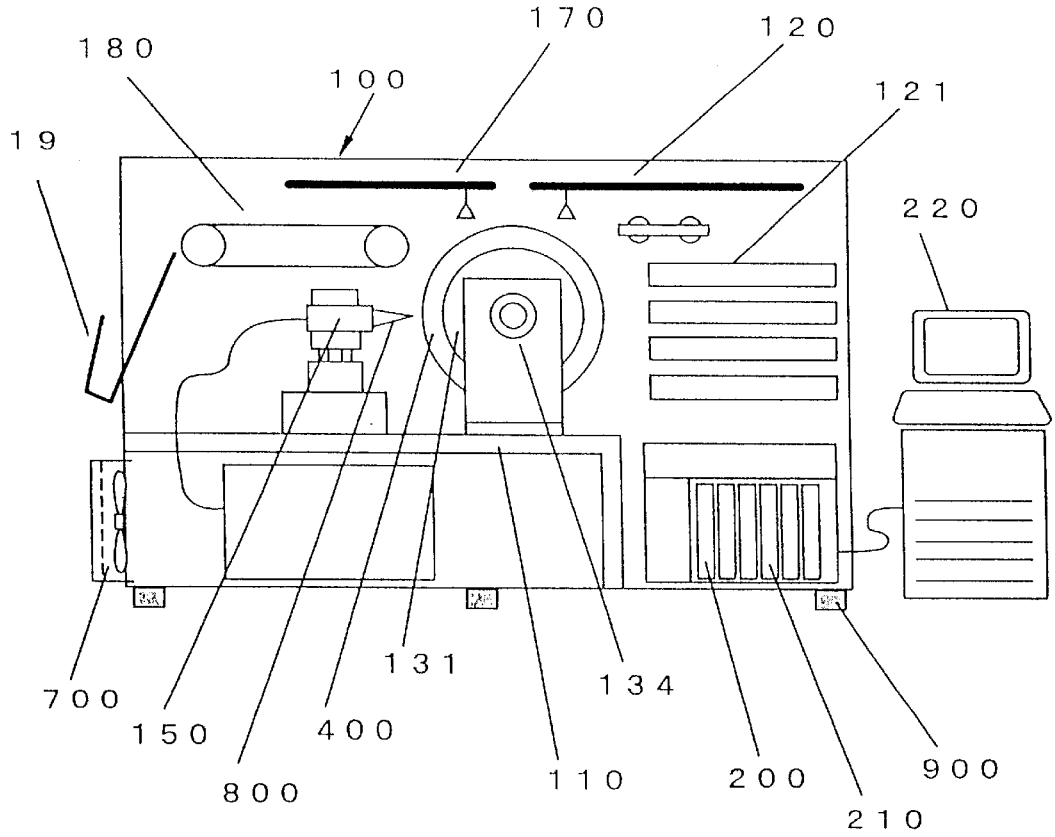
FIG. 1 is a schematic side elevational view showing a print making apparatus corresponding to a first embodiment according to the present invention.
Figure 2:
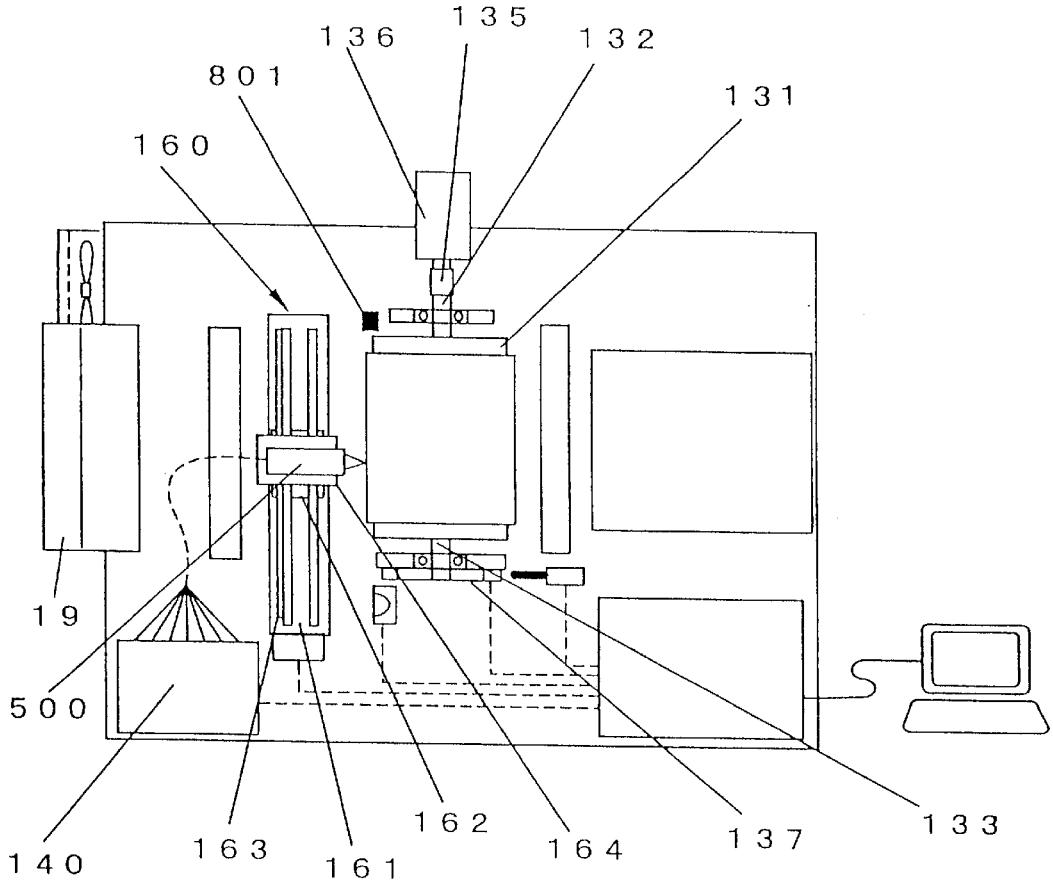
FIG. 2 is a schematic plan view of the plate making apparatus shown in FIG. 1.

As shown in FIG. 1 and FIG. 2, a plate making apparatus 100 comprises a hollow cylinder 131 having a rotational mechanism, a cassette 121 for keeping a plurality of blank plates 400, a blank plate supply mechanism 120, a laser generation device 140, an optical head (laser irradiation head) 150, a linear stage (head moving mechanism) 160, a plate discharge mechanism 170, a plate discharge conveyor 180, a plate receiving tray 19, a control computer 200, an electronic control device (irradiation condition setting device) 210, and an RIP server 220 (computer connected to a network for exclusively conducting RIP process). Further, the plate making apparatus 100 has a blank plate attaching mechanism 130 shown in FIG. 5 and FIG. 6. Reference numeral 900 in FIG. 1 indicates a vibration proof rubber.

The blank plate 400 is a heat sensitive type offset blank plate and the blank plate used herein comprises a hydrophilic layer as a heat sensitive layer formed on a support made of a thin aluminum sheet, the hydrophilic sensitive layer comprising a material that contains microcapsules containing an oleophilic ingredient in the inside and destroyed thermally, hydrophilic binder polymer having functional groups capable of three-dimensional crosslinking and functional groups capable of reacting with the oleophilic ingredient, and photoreaction initiator for initiating three-dimensional crosslinking reaction of the hydrophilic binder polymer. Such a blank plate is formed, for example, by a method described in Japanese Patent Unexamined Publication No. 7-1849.

The cassette 121 has a structure capable of keeping about 100 sheets of blank plates in stack with the heat sensitive layer being faced upward, and supplement of the blank plate is informed by a photosensor for detecting the absence or presence of the blank plate 400.

Figure 5:
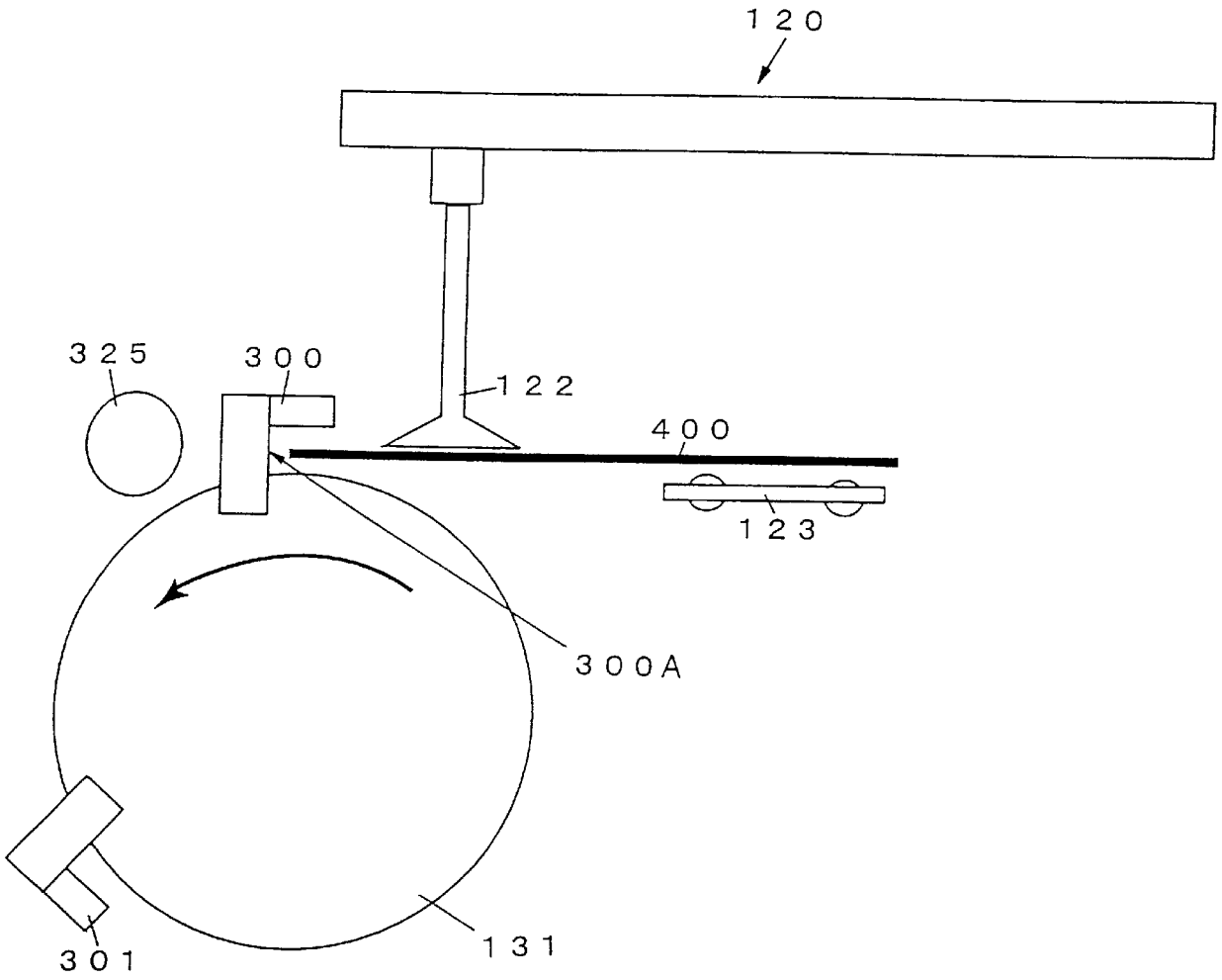
FIG. 5 is a schematic side elevational view showing a blank plate supply mechanism and a blank plate attaching mechanism constituting the plate making apparatus shown in FIG. 1.

The blank plate supply mechanism 120, as shown in FIG. 5, has a vacuum suction pad 122 for sucking under vacuum the upper surface of the blank plate 400 to take out the blank plate 400 from the cassette 121, and a group of rolls 123 for transporting the blank plate 400 toward the hollow cylinder 131 while receiving the lower surface of the blank plate 400 and preventing sagging of the lower end thereof. Thus, the blank plate 400 is conveyed to the hollow cylinder 131 from the lateral direction.

Figure 6:
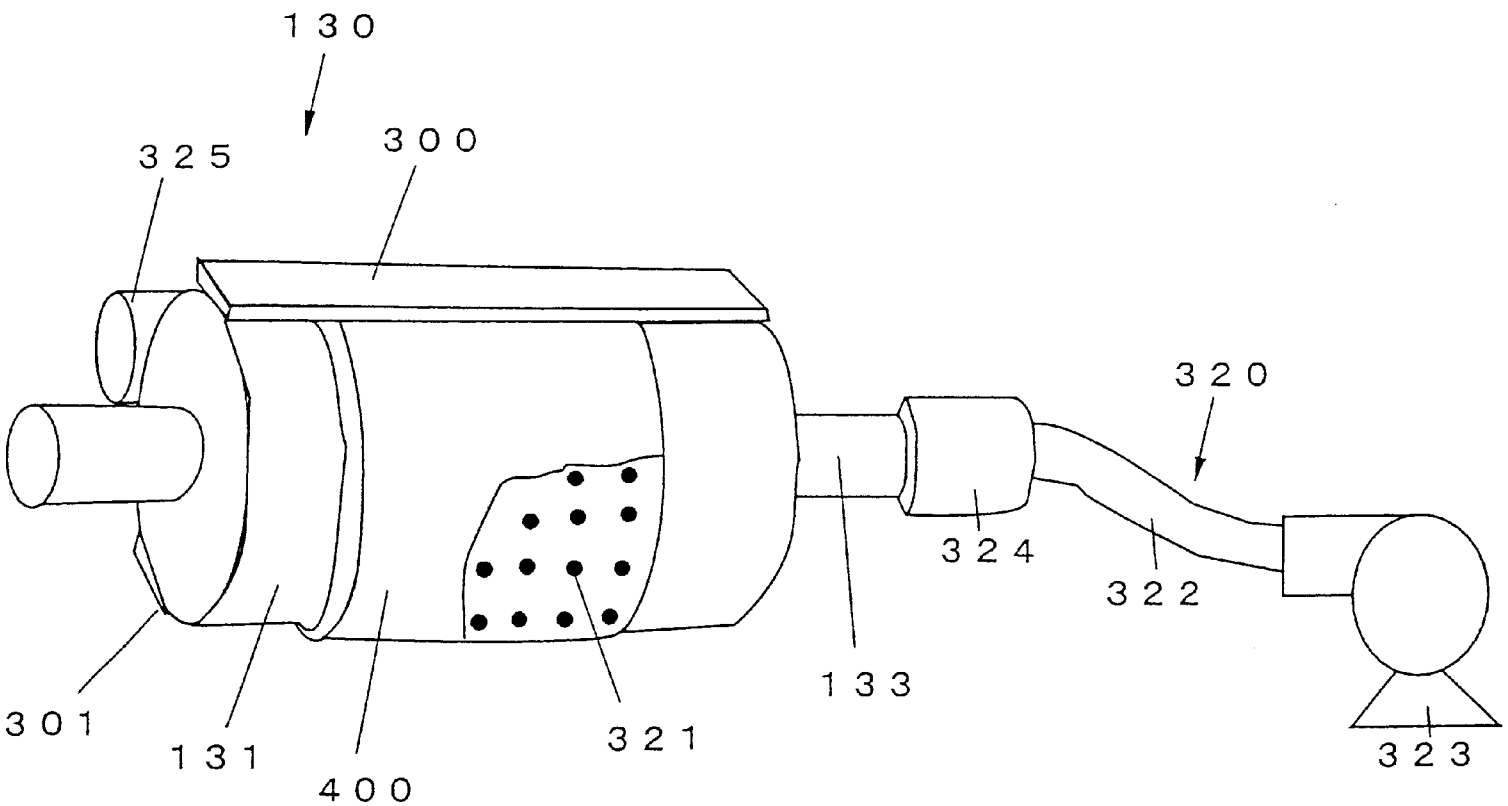
FIG. 6 is a schematic perspective view showing a plate attaching mechanism constituting the plate making apparatus shown in FIG. 1.

The blank plate attaching mechanism 130, as shown in FIGS. 5 and 6, has a top end clamp mechanism 300, a rear end clamp mechanism 301, a squeeze roll 325 and a vacuum suction mechanism 320.

The top end clamp mechanism 300 is attached at a predetermined position of the hollow cylinder 131 for seizing the top end of the blank plate 400 and, has a seizing surface opposing to the circumferential surface of the hollow cylinder 131 and a positioning surface 300A opposing to the top end surface of the blank plate 400 being conveyed toward the hollow cylinder 131. The rear end clamp mechanism 301 is attached at a predetermined position of the hollow cylinder 131 for seizing the rear end of the blank plate 400 and the structure thereof is identical with that of the top end of the clamp mechanism 300.

Accordingly, the top end of the blank plate 400 being conveyed by the blank plate supply mechanism 120 in the lateral direction to the hollow cylinder 131 is inserted in a gap (several millimeters) between the top end mechanism 300 and the cylinder surface, and touched against a positioning surface 300A with a weak force. Since positioning is thus conducted by utilizing one side at the top end of the blank plate 400, image positioning for four plates in the subsequent process color printing step can be conducted easily.

The blank plate supply mechanism 120 has a mechanism of finely correcting the conveying speed of the blank plate 400 such that the top end surface of the blank plate 400 touches the positioning surface 300A of the top end clamp mechanism 300 uniformly over the entire surface without causing twisting or the like at the top end of the blank plate 400.

After the positioning, the opposing surface of the top end clamp mechanism 300 to the circumferential surface of the cylinder moves toward the circumferential surface of the cylinder 131, thereby the top end of the blank plate 400 is put and held between the top end clamp mechanism 300 and the circumferential surface of the hollow cylinder 131 while being kept in the positioned state. In this state, the hollow cylinder 131 is rotated and, at the same time, the squeeze roll 325 is pushed against the blank plate 400. Thus, the blank plate 400 is wound around the hollow cylinder 131 and the rear end thereof is seized by the rear end clamp mechanism 301. In this way, the blank plate 400 conveyed from the blank plate supply mechanism 120 is wound around the circumferential surface of the hollow cylinder 131 while being kept in the positioned state.

The vacuum suction mechanism 320 is used for firmly holding the blank plate 400 wound around the circumferential surface of the hollow cylinder 131 to the hollow cylinder 131, so that the attaching position does not change even if the hollow cylinder 131 is rotated at a high speed.

As shown in FIG. 6, the vacuum suction mechanism 320 comprises vacuum suction holes 321 (fine through holes of about 1 to 3 mm diameter) formed to the outer circumferential surface of the hollow cylinder 131, an evacuation/air supply source 323 for discharging air from a cavity in the hollow cylinder 131, and a pipeline 322 connecting the inside of the hollow cylinder 131 with the evacuation/air supply source 323. The pipeline 322 is disposed passing through the inside of the shaft 133 and the end thereof on the side of the hollow cylinder 131 is disposed in the cavity of the hollow cylinder 131. Further, the shaft 133 and the pipeline 322 are connected with a rotatable rotary joint 324.

Accordingly, after winding the blank plate 400 to the hollow cylinder 131 as described above, and then evacuating air in the hollow cylinder 131 by the evacuation/air supply source 323, thereby air in the gap between the hollow cylinder 131 and the blank plate 400 is compulsorily discharged through the vacuum suction holes 321. As a result, the blank plate 400 is firmly secured by vacuum suction.

The hollow cylinder 131 is installed horizontally on a rack base 110. The rotational mechanism of the hollow cylinder 131 comprises shafts 132 and 133 protruded from both ends, bearings 134 for rotatably supporting the shafts 132 and 133, a rotation motor 136 connected to the end of the shaft 132 with a coupling 135, and a rotary encoder 137 disposed to the end of the shaft 133 for measuring the rotational angle of the hollow cylinder 131.

The rotation motor 136 having a power of rotating the hollow cylinder 131 at a rotational speed of 50 to 3000 rpm is used. When the blank plate has a large size, the outer diameter of the hollow cylinder 131 is, for example, from 250 to 500 mm. When highly fine image data exceeding 1000 dpi (dot/inch) are formed as an image by using such a large hollow cylinder 131, it is practically preferred to keep the rotational speed of the hollow cylinder 131 to about 1000 rpm or lower in view of the restriction for the performance of a general optical rotary encoder measuring system. A high performance optical rotary encoder having high resolution is easily available from "HEIDENHAIN Co." or "Canon Co.".

Figure 3:
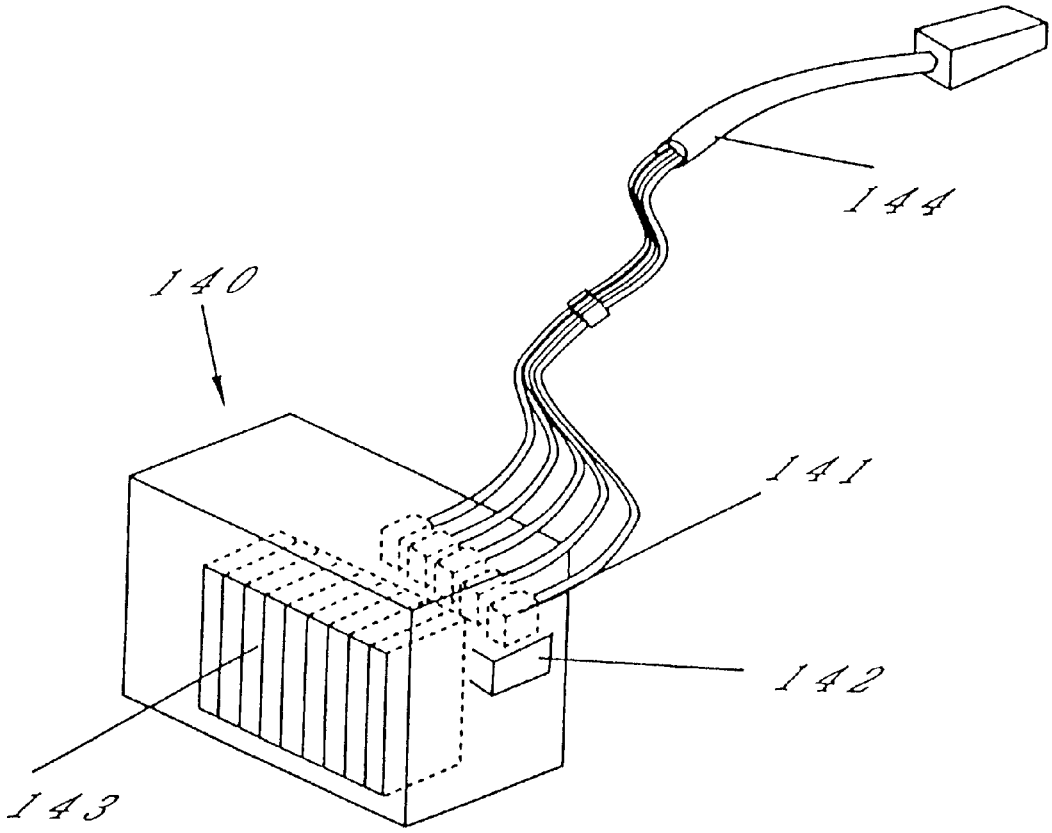
FIG. 3 is a schematic perspective view showing a laser generation device constituting the plate making apparatus shown in FIG. 1.

The laser generation device 140 is used for generating a laser beam 800 in an infrared region to be irradiated to the blank plate 400. As shown in FIG. 3, it comprises a plurality of semiconductor layers 141, a heat sink base 142 having cooling Peltier devices mounted thereon, a laser driving device 143, and a fiber bundle 144. The plurality of semiconductor lasers 141 are fiber-coupled and disposed on the heat sink base 142.

As the semiconductor laser 141, those generating infrared laser at an oscillation wavelength of 750 to 880 nm are used and it is preferred to select those having an optimal oscillation wavelength in accordance with the absorption spectrum of an infrared absorbent added to the heat sensitive layer of the blank plate 400. Further, it is most preferred to use a semiconductor layer having an oscillation wavelength at 810 to 850 nm in view of the overall performance as the device such as size, cost and working life.

In a case of forming a highly fine image with resolution exceeding 1000 dpi, the core diameter of the optical fiber coupled to the semiconductor laser 141 is preferably 100 $\mu$m or less, and numeral aperture (NA) is generally from 0.12 to 0.15. Such a fiber-coupled semiconductor laser is available easily from "SDL Co." or "OPTOPOWER Co.".

As the fiber bundle 144, those comprising bundled fibers having the same shape and function as the optical fibers used for the fiber-coupled semiconductor laser 141 are used. Each of the optical fibers of the fiber bundle 144 is connected with the semiconductor laser 141 by a connector or fusion splicing.

In the sheath at the top end of the fiber bundle 144, optical fibers are arranged laterally each at an equal distance with the pitch of several hundreds $\mu$m and aligned and fixed such that laser beam from each of the optical fibers is in parallel with each other. Thus, a group of laser beams arranged in line are generated from the sheath at the top end of the fiber bundle 144.

Further, if the length of the fiber bundle 144 is as long several meters, it is preferred to insert the fiber bundle 144 into a flexible pipe made of plastic or metal for protection.

If the semiconductor laser 141 is a laser that generates an output energy of about 1 W, a voltage at about 2–3 V is applied as a DC power source from the laser driving device 143 to the semiconductor laser 141. It is preferred that a current of about 500 to 2000 mA at the maximum is supplied to the semiconductor laser 141 upon image formation, while it is preferred to supply a bias current of 20 to 100 mA which is a current giving no thermal effects on the surface of the blank plate 400 when the image is not formed such that the semiconductor laser 141 instantaneously reaches the maximum power intensity.

Figure 4:
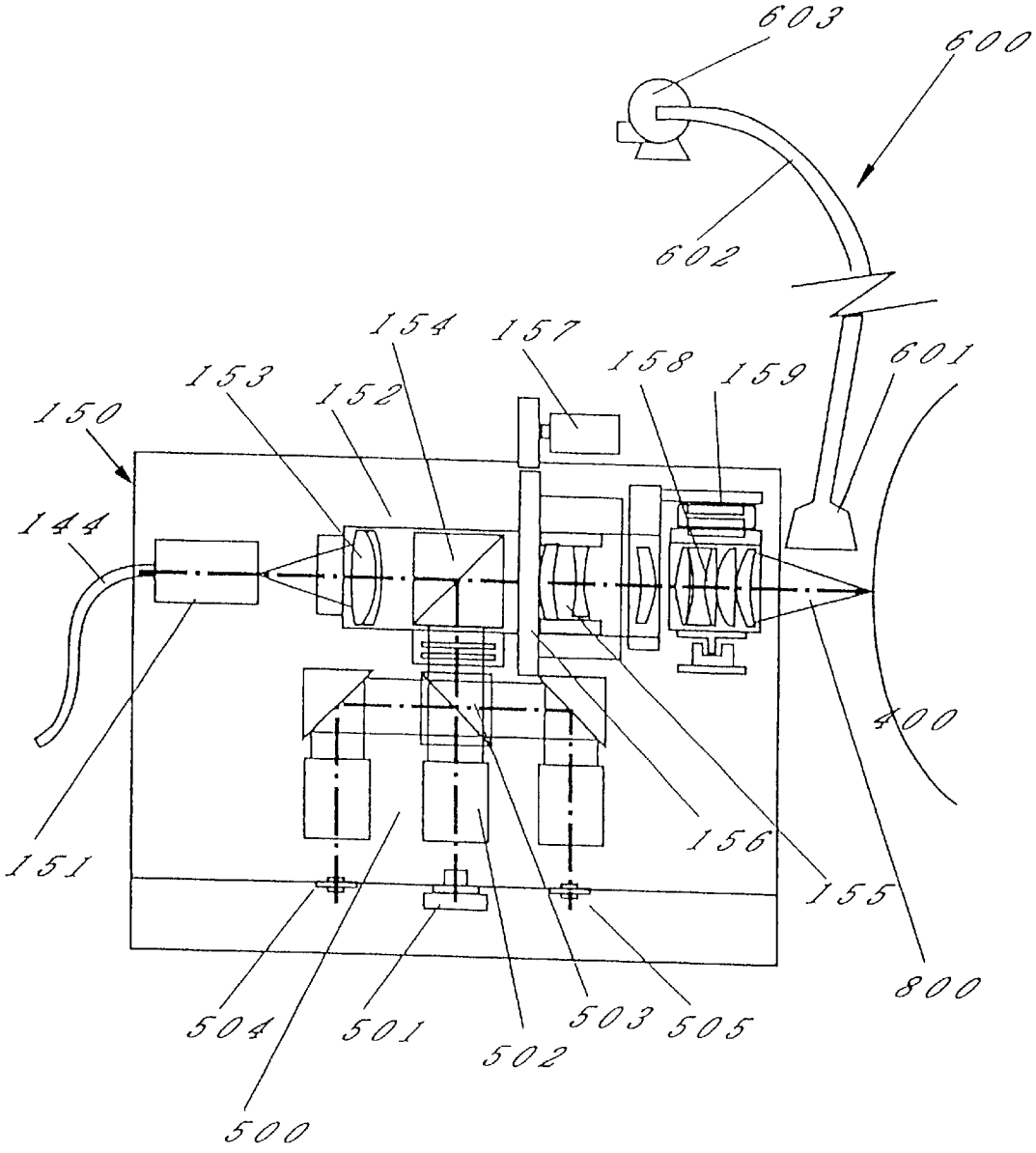
FIG. 4 is a schematic cross sectional view showing an optical head constituting the plate making apparatus shown in FIG. 1.

The top end sheath of the fiber bundle 144 is held, as shown in FIG. 4, by a fiber bundle securing portion 151 of an optical head 150.

The optical head 150 comprises a lens cylinder 152, a group of condensing lenses 153, a prism 154, a group of zoom lenses 155, a zoom mechanism 156, a zoom motor 157, a group of objective lenses 158, an objective lens-actuator 159 and an astigmatism sensing mechanism 500.

The infrared laser beam irradiated from the semiconductor laser 141 is transmitted through the optical fibers and, finally, emitted from the final end of the sheath of the fiber bundle 144 as the group of laser beams arranged in line to the outside. The group of condensing lenses 153 condense the laser beams into parallel light, and the infrared laser beams converted into the parallel light are focused on the surface of the blank plate 400 wound around the hollow cylinder 131 into a beam spot diameter of several to several tens $\mu$m through the prism 154, the group of zoom lenses 155, and the group of objective lens 158.

The beam spot diameter to be focused on the surface of the blank plate 400 can be optionally determined by varying the optical reduction factor of the group of zoom lens 155 and the group of objective lens 158. Practically, the lenses having a maximum reduction factor of about 5 are selected with the reason, for example, of intending to ensure a distance of (working distance) several $\mu$m or more from the top end of the optical head 150 to the surface of the blank plate 400 and intending to minimize the intensity loss of the laser beams without enlarging the size of the optical system such as the lens or the lens cylinder 152 extremely.

For this purpose, if the fiber core diameter used for the fiber bundle 144 is 50 $\mu$m, a beam spot diameter of about 10 $\mu$m at the minimum can be obtained on the surface of the blank plate 400. A further smaller beam spot diameter can of course be obtained by making the fiber core diameter of the fiber bundle 144 smaller. Further, while smaller beam spot diameter can also be obtained by choosing a lens with a further maximum reduction factor, the intensity loss of the laser beam is increased.

Further, the zoom lens group 155 is adapted to change the relative position in accordance with the movement of the zoom mechanism 156. Since the zoom mechanism 156 advances or retracts and the relative position in the zoom lens group 155 is also changed together by the rotation of the zoom motor 157 that is gear-coupled with the zoom mechanism 156, the optical reduction factor is changed in accordance therewith. Then, if the zoom lens is chosen such that the zoom factor can be varied within range from 1 to 5 times, the beam spot diameter focused on the surface of the blank plate 400 can be changed optically within a range from 10 to 50 $\mu$m.

The astigmatism sensing mechanism 500 comprises a visible light semiconductor laser 501 having a wavelength region of 600 to 700 nm and a maximum power energy of about several tens mW, a beam shaping mechanism 502, a prism group 503, an automatic power control mechanism 504 and a 4-divisional photodetector 505. A visible light laser beam irradiated from the visible light semiconductor laser 501 is shaped by the beam shaping mechanism 502 into parallel light and separated partially at the prism 503. The separated beam is detected by the photodiode of the automatic power control mechanism 504. The current supplied to the visible light semiconductor laser 501 is controlled by the output signal of the photodiode to keep the output power of the laser constant.

The visible light laser beam other than the beam transmitting the prism 503 is reflected at a diagonal plane of the prism 154, superimposed with the image forming infrared laser beam 800 and entered to the blank plate 400. Most of the visible light laser beam is reflected on the surface of the blank plate 400 and entered again in the plasmas 154 and 503 and reflected. The reflected light is given with astigmatism by a cylindrical lens on the optical path and finally fed back to the 4-divisional photodetector 505.

In this mechanism, output signals of the 4-divisional photodetector 505 are added diagonally to each other and further subtracted diagonally from each other, and these values are inputted as focus error signals to a focus-servo control circuit and an objective lens-actuator 159 is operated by the output signal from the focus-servo control circuit. By the mechanism, the objective lens group 158 suspended by a leaf spring from the objective lens-actuator 159 moves forward and backward. Thus, the image forming infrared laser beam 800 is focused together with the visible light laser beam on the surface of the blank plate.

On the other hand, the optical head 150 is placed on the linear stage 160 as a movable support means, and can be moved linearly by the linear stage 160 in the longitudinal direction of the axis of the hollow cylinder 131. The linear stage 160 comprises a linear motor guide 161 disposed in parallel with the hollow cylinder 131, a linear motor 162, a linear scale 163 and a support table 164 used for the optical head connected with the linear motor 162.

Image formation by the optical head 150 (irradiation of the laser beam) is conducted over the entire surface of the blank plate 400 by the movement of the linear stage 160 having the optical head mounted thereon and the rotation of the hollow cylinder 131. That is, image formation from the optical head 150 to the blank plate 400 is conducted for a predetermined width in the direction of the cylinder axis during one rotation of the hollow cylinder 131, and the optical head 150 moves by a predetermined amount in the direction of the cylinder axis on every one rotation of the hollow cylinder 131. The process is repeated in entire axial direction of the cylinder.

Then, the size of the blank plate 400 in the circumferential direction of the hollow cylinder 131 is made smaller than the circumference of the hollow cylinder 131 (up to about 70 to 80% of the circumference) to provide a marginal portion where the blank plate is not attached to the outer circumferential surface of the hollow cylinder 131. Then, the operation of the linear stage 160 is controlled such that the optical head 150 is not moved while the optical head 150 opposes to the blank plate attaching surface of the hollow cylinder 131, and the optical head 150 is moved by a predetermined amount in the direction of the rotational axis of the hollow cylinder 131 while the optical head 150 is opposed to the marginal portion of the hollow cylinder 131.

Thus, when an image is formed to the entire surface of the blank plate 400, it is no more necessary to stop the rotation of the hollow cylinder or form the image once per two rotations of the hollow cylinder 131 (image is formed during first rotation and the linear stage is moved during the succeeding rotation), so that the image can be formed efficiently over the entire surface of the blank plate 400 with no additional useless rotation.

The moving amount of the optical head 150 is defined as a distance obtained by multiplying the beam pitch corresponding to resolution of the image data to be formed to an image by the number of laser beams.

An RIP server 220 receives image data made by DTP or an electronic composing machine by a communication protocol such as TCP/IP or Apple Talk by way of a network line (Ethernet, etc.) and makes bit map data by applying RIP process to the received image data. Subsequently, the bit mat data is compressed by an algorithm such as a run length method to decrease the capacity of the bit map data.

The control computer 200 receives the compressed bit map data from the RIP server 220 by way of the interface line, (for example, SCSI) and stores the data in the main memory (RAM) in the control computer 200. The control computer 200 properly defreezes the compressed bit mat data stored in the main memory and restores the data into the original bit map data and then transfers the restored bit map data by way of a control bus (Compact PCI or VME bus) to the line memory of the electronic control device 210.

The electronic control device 210 has two sets of line memory of functions referred to as A bank/B bank and forms an image with the bit map data contained in one of the line memories (A bank) while transferring the bit map data for the next line to another empty line memory (B bank). It is adapted to complete transferring of the bit mat data in parallel while forming an image within a period for one rotation of the hollow cylinder 131 by alternately switching image formation and relocation.

Further, the electronic control device 210 has a receiving counter for the data of rotational angle sent from the rotary encoder 137 and calculates the basic number of pulses between pixels based on the outer diameter of the blank plate 400, resolution angle per one pulse from the rotary encoder 137 and setting resolution of the image. Further, the position for starting image formation to the blank plate 400 is calculated based on the rotational position information of the hollow cylinder 131 formed on real time in accordance with rotation of the hollow cylinder 131, to determine the position for completing image formation on every laser based on the rotational circumferential speed of the hollow cylinder 131 and the laser irradiation time previously determined individually on every laser.

Then, the electronic control device 210 superimposes the thus determined position for completing image formation on every laser and a logic signal of the bit map data, and outputs the superimposed control signal to the laser driving device 143 of the laser generation device 140. Thus, the laser driving device 143 controls the image formation time on very laser independently.

In this case, the set value for the irradiation time for each of the lasers is previously calculated based on the material and the thickness of the heat sensitive layer of the blank plate 400 to be used and the beam position at which the group of laser beams arranged in line are emitted finally. With respect to the beam position, the irradiation time is set shorter at the center of the line, while the irradiation time is set longer toward the ends of the line. This can make the temperature of the blank plate 400 uniform within a region in which an image is formed at once by a group of laser beams arranged in line.

Accordingly, in the plate making apparatus, the temperature of the blank plate 400 is made uniform over the entire region in which the image is formed in one rotation of the hollow cylinder 131 and the group of beams 800 arranged in line are moved repeated in the direction of the axis of rotation on every one rotation of the hollow cylinder 131, so that the image is formed by uniform heat sensitive reaction over the entire surface of the heat sensitive layer of the blank plate 400. This can remarkably improve the image quality of the obtained printing plate.

Further, the plate making apparatus 100 has an infrared intensity sensor 801 having a photo-receiving surface at the focusing position of the image-forming infrared laser beam 800 beside the hollow cylinder 131, so as to move the linear stage 160 to a position at which the image forming infrared resin beam 800 is detected by the infrared intensity sensor 801 upon actuation of the plate making apparatus or at an appropriate timing.

In this constitution, one laser is turned on by the laser driving device 143 for several seconds, the measured intensity data is taken into the control computer 200 to control the laser driving current of the laser generation device 140, and the laser beam is irradiated at a predetermined laser intensity to the blank plate 400. Then, by repeating the process successively for the number of the laser beams, the laser intensity is set on every laser independently.

Further, it may be adapted such that the window of the semiconductor laser 141 opposing to an oscillator emitter window is made as a half-mirror structure, a portion of the laser beam generated in the oscillator is taken out and detected by the photodiode to control the laser intensity like that in the means described above.

Further, a plate discharge mechanism 170 is disposed above the hollow cylinder 131 of the plate making apparatus 100. A vacuum suction pad is disposed to the plate discharge mechanism 170, and the blank plate 400 after completing the image formation is sucked under vacuum by the vacuum suction pad, detached out of the hollow cylinder 131 and transported to the plate discharge conveyor 180. The blank plate 400 transported to the plate discharge conveyor 180 is received by the plate receiving tray 19.

Second Embodiment

Figure 7:
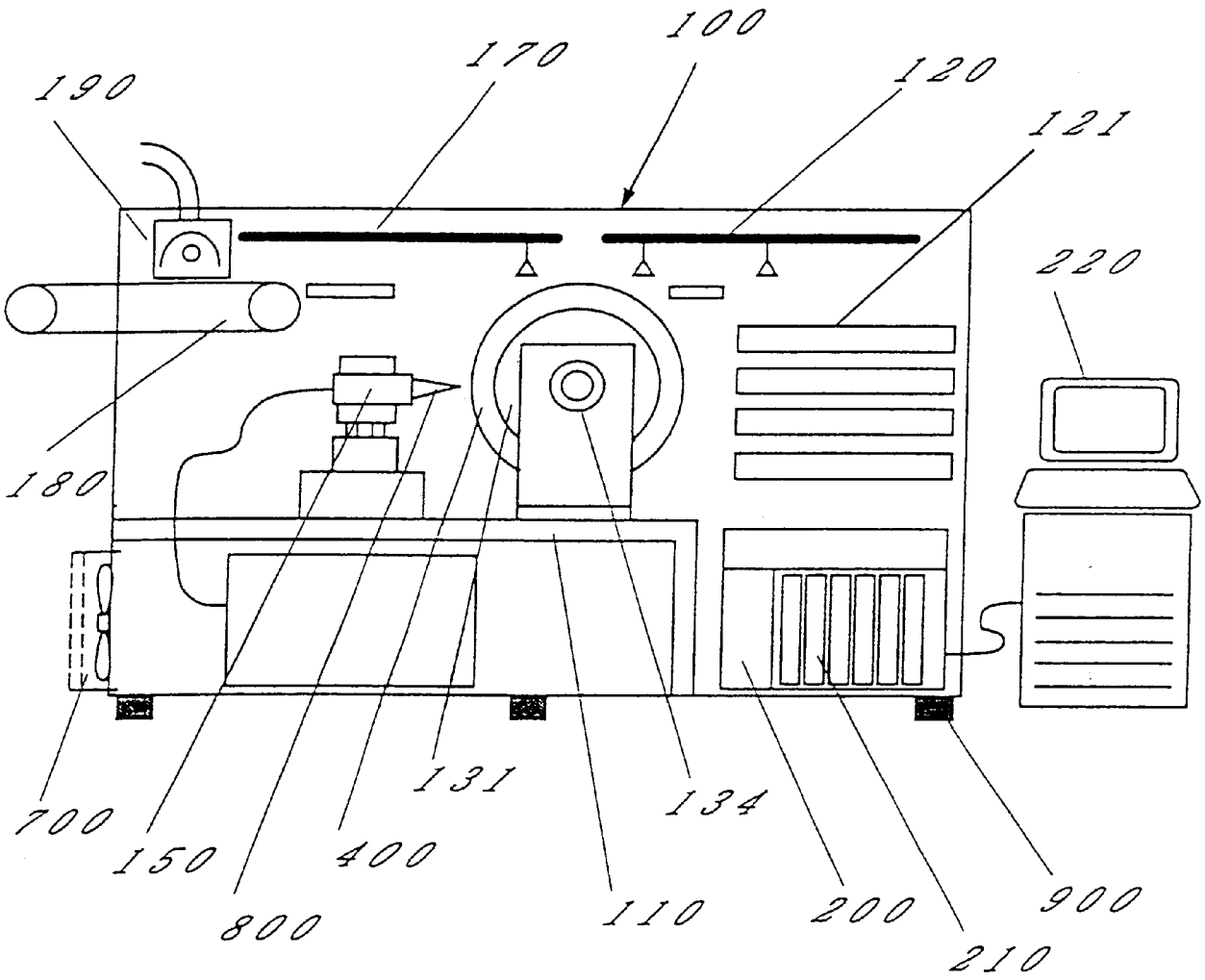
FIG. 7 is a schematic side elevational view showing a plate making apparatus corresponding to a second embodiment according to the present invention.
Figure 8:
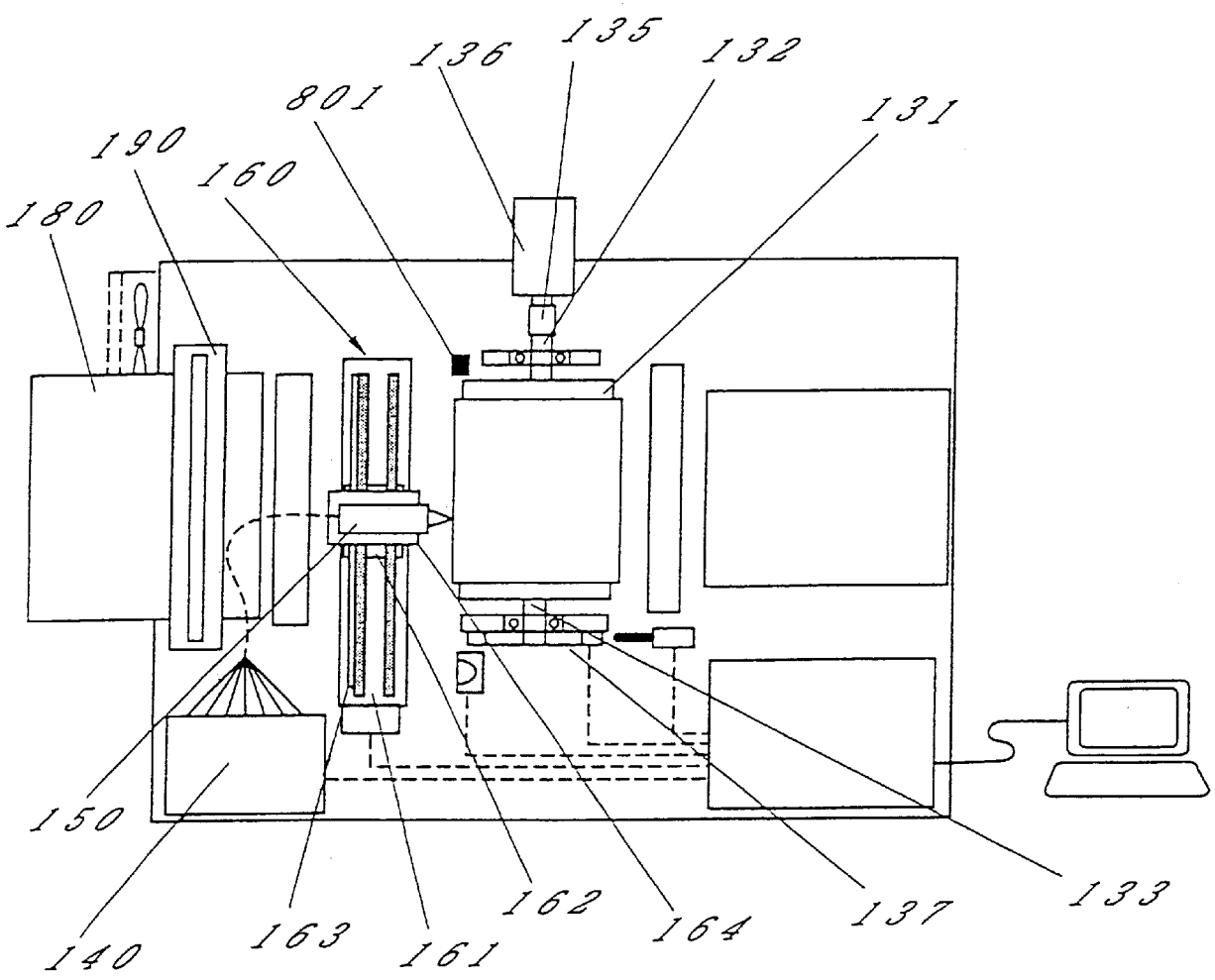
FIG. 8 is a schematic plan view of the plate making apparatus shown in FIG. 7.

A second embodiment of the plate making apparatus according to the present invention is to be explained with reference to FIGS. 7 to 9. As can be seen from comparison between FIG. 1 and FIG. 7 and comparison between FIG. 2 and FIG. 8, the plate making apparatus 100 is different from the first embodiment, in that a UV-ray irradiation device 190 for irradiating UV-rays to a blank plate transported to the plate discharge conveyor 180 is disposed but is identical with the first embodiment in other constitutions.

Figure 9:
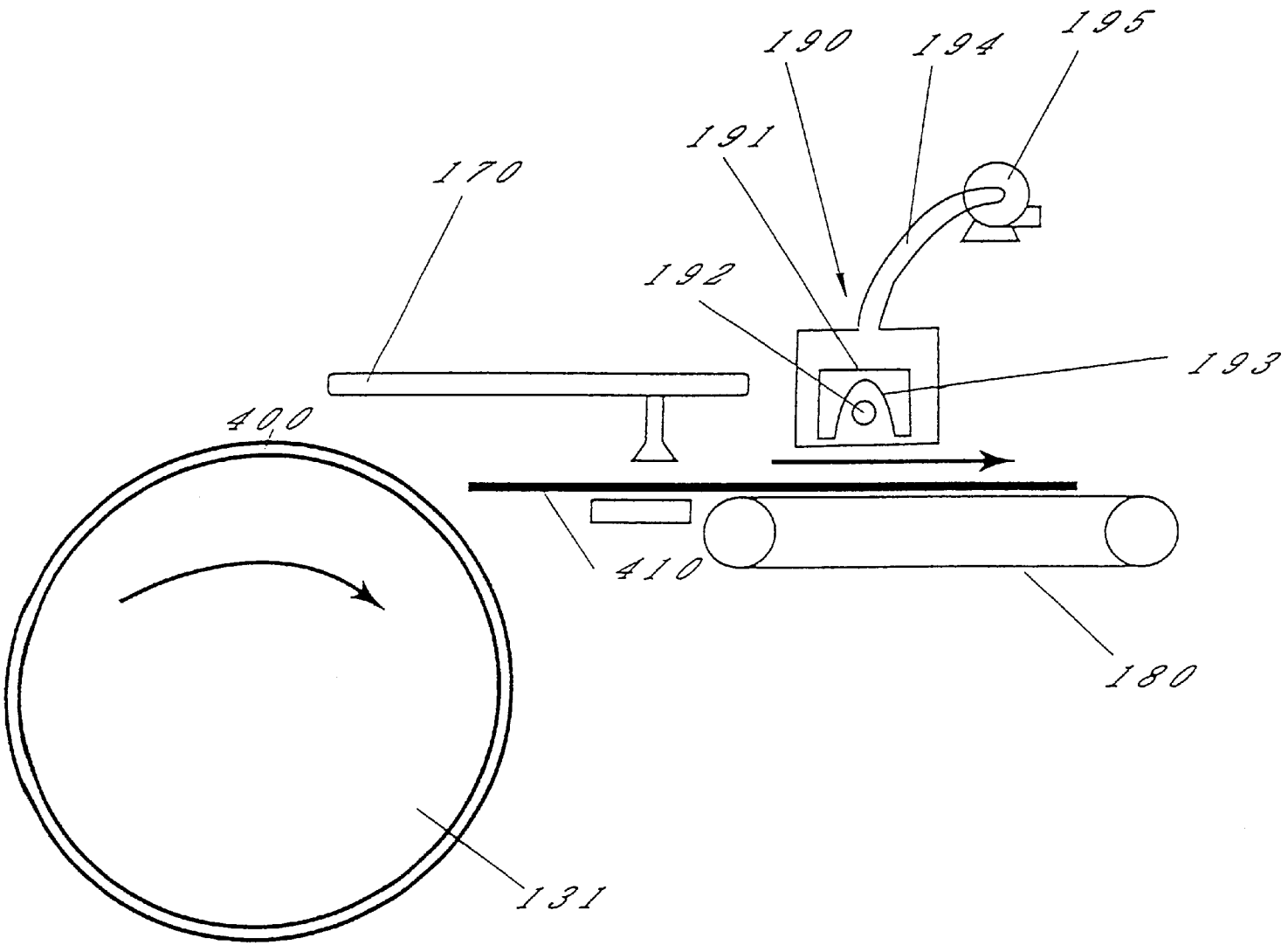
FIG. 9 is a schematic side elevational view showing the constitution of the apparatus conducting a post treating step by irradiation of UV-rays in the plate making apparatus shown in FIG. 7.

As shown in FIG. 9, a blank plate 410 on the plate discharge conveyor 180 is put to a post treatment by irradiation of UV-rays from the UV-ray irradiation device 190 along with movement of the plate discharge conveyor 180. By the post treatment, the printing resistance and the printing quality for the obtained image portion of the plate are improved remarkably.

A metal hydride lamp is used for the lamp 192 of the UV-ray irradiation device 190 and an inverter power source is used as a control power source for the metal halide lamp, and the lamp intensity is optionally variable within a range from 25 to 100%. Further, the lamp is air-cooled by a air cooling exhaust blower 195 and an exhaust duct 194. Further, the lamp 192 is attached to a housing 191 capable of rotating by 180° and an aluminum reflection plate 193 is disposed at a position of the housing 191 for the back of the lamp 192.

In this embodiment, since a long metal halide lamp can not be turned on instantaneously, it is lighted up in a stand-by state with a weak lamp intensity of about 25%, and a portion between the lamp 192 and a plate discharge conveyor 180 is shielded by the housing 191 so as not to leak UV-rays onto the plate discharge conveyor 180 by rotating the housing for 180°.

Then, the blank plate 410 is detached from the hollow cylinder 131 by a plate take-out pad 170 and transported to a plate discharge conveyor 180 and, at the same time, the plate discharge conveyor 180 is driven and the housing 191 rotates by 180° to return to the position above the lamp 192, and the power of the metal halide lamp 192 is increased to 100% lamp intensity.

Further, when the blank plate 410 passes below the UV-ray irradiation device 190, the housing 191 rotates by 180° and returns to the stand-by position, and the power of the metal halide lamp 192 is lowered to a weak lamp intensity.

It is necessary to increase or decrease the amount of irradiation energy of UV-rays in accordance with the amount of irradiation energy of UV-rays required for the blank plate, and this can be increased or decreased by increasing or decreasing the lamp intensity of the metal halide lamp 192 with inverter power supply. In addition to the above, since a speed variable mechanism is attached to the plate discharge conveyor 180, the amount of irradiation energy of UV-rays can be easily increased or decreased by changing the speed of the plate discharge conveyor 180.

In this embodiment, an air-cooled type metal halide lamp is used as the lamp 192 of the UV-ray irradiation device 190, and same effect can also be expected by using a high pressure mercury lamp, super-high pressure mercury lamp or a chemical lamp or sterilizing lamp providing that the emission wavelength is within a ultra-violet region of 200 to 400 nm. Accordingly, the lamp to be used can be selected properly depending on the irradiation energy requiring for the blank plate.

Further, if temperature elevation is undesired for the blank plate, it is preferred to make the reflection plate with a cold mirror allowing only the heat rays to permeate therethrough selectively instead of the aluminum reflection plate, or additionally dispose heat ray absorbing glass just below the lamp. For shielding heat rays more effectively, it is preferred to adopt a water-cooled type metal halide lamp of inserting a lamp in a water cooled blow filter jacket tube capable of cutting off visible rays at 450 nm or higher or heat rays by nearly about 100%.

As shown in FIG. 4, it is preferred in the plate making apparatus according to the present invention to provide a vacuum suction mechanism 600 between an optical lens head 150 and a hollow cylinder 131, to prevent mists that are evaporated and scattered by thermal reaction from the surface of the blank plate during image formation to the blank plate 400 from depositing on the lens surface of the objective lens group 158. The vacuum suction mechanism 600 comprises a dust collecting hood 601, a vacuum pump 603, a filter and an exhaust duct 602.

In this embodiment, the dust collecting hood 601 of the vacuum suction mechanism 600 is disposed on the support table 164 and the vacuum suction mechanism 600 is controlled to be moved together with the linear stage 160, for example, by the control computer 200.

Further, when the plate making apparatus according to the present invention is constituted as a tightly closed structure in which a cover is attached to the frame of the apparatus, clean air generated from a clean air supply mechanism 700 constituted with an air blower and an air filter (refer to FIG. 1 and FIG. 7) is sent into the apparatus to keep a pressurized state thereby keeping the inside of the apparatus clean, undesired effect of dusts or dirts in the atmosphere of the room can be eliminated, so that an offset printing plate of more excellent printing quality can be manufactured.

Industrial Applicability

As has been described above, the method of the present invention is a plate making method of forming an image to a heatsensitive type blank plate by an outer surface cylinder scanning system plate making apparatus.

Then, according to the method of the present invention, since image formation with a uniform heat sensitive reaction is conducted for the entire surface of the heat sensitive layer of the blank plate in an image forming step by a multi-channel system, the image quality of the obtained printing plate can be improved outstandingly. Further, by conducting positioning utilizing one side at the top end of the blank plate, accurate positioning for blank plates of four colors can be conducted conveniently in a short time upon process color printing using the thus obtained printing plate. Further, the printing quality of the obtained printing plate can be improved outstandingly by conducting the post treating step.

In view of the above, according to the method of the present invention, a practical heat sensitive type offset printing plate can be obtained at a commercial level.

Further, according to the apparatus of the present invention, the method of the present invention can be practiced with ease.

What is claimed is:

1. A method of making an offset printing plate, comprising:

a blank plate attaching step of winding a plate-shaped blank plate having a heat sensitive layer to which an image is formed thermally on a support around an outer circumferential surface of a cylinder with the heat sensitive layer being directed outward, thereby making the blank plate rotatable integrally with the cylinder; and an image forming step of irradiating a group of beams comprising a plurality of infrared laser beams arranged in line to the blank plate on the outer circumferential surface of the cylinder based on an image forming signal while rotating the cylinder, thereby forming an image in accordance with the image forming signal to the heat sensitive layer of the blank plate;

wherein, in the image forming step, the group of beams in line are irradiated to a single area on the blank plate; and wherein irradiation conditions for the plurality of infrared laser beams comprising the group of beams are determined individually such that the temperature of the blank plate is made uniform within the single area in which the image is formed at once by the group of beams in line.

2. The method of making an offset printing plate as defined in claim 1, wherein the blank plate attaching step has a step of securing the top end of the blank plate to the circumferential surface of the cylinder by a clamp mechanism, positioning is conducted by utilizing one side at the top end of the blank plate upon securing by the clamp mechanism and the blank plate is attached while being kept in the positioned state.

3. The method of making an offset printing plate as defined in claim 1, wherein a post treating step of irradiating UV-rays at a wavelength of 200 to 400 nm to the heat sensitive layer of the blank plate is conducted after the image forming step.

4. The method of making an offset printing plate as defined in claim 2, wherein a post treating step of irradiating UV-rays at a wavelength of 200 to 400 nm to the heat sensitive layer of the blank plate is conducted after the image forming step.

5. A method of making an offset printing plate, comprising:

a blank plate attaching step of winding a plate-shaped blank plate having a heat sensitive layer to which an image is formed thermally on a support around an outer circumferential surface of a cylinder with the heat sensitive layer being directed outward, thereby making the blank plate rotatable integrally with the cylinder; and an image forming step of irradiating a group of beams comprising a plurality of infrared laser beams to the blank plate on the outer circumferential surface of the cylinder based on an image forming signal while rotating the cylinder, thereby forming an image in accordance with the image forming signal to the heat sensitive layer of the blank plate;

wherein, in the image forming step, the group of beams in line are irradiated to a single area on the blank plate; and wherein a post treating step of irradiating UV-rays at a wave length of 200 to 400 nm to the heat sensitive layer of the blank plate is conducted after the image forming step.

6. The method of making an offset printing plate as defined in claim 3, wherein the heat sensitive layer contains microcapsules containing an oleophilic agent in the inside and destroyed thermally, hydrophilic binder polymer having functional groups capable of three-dimensional crosslinking and functional groups capable of reacting with the oleophilic ingredient, and photoreaction initiator for initiating the three-dimensional crosslinking reaction of the hydrophilic binder polymer, and the hydrophilic binder polymer is three-dimensionally crosslinked by the post treating step.

7. The method of making an offset printing plate as defined in claim 4, wherein the heat sensitive layer contains microcapsules containing an oleophilic agent in the inside and destroyed thermally, hydrophilic binder polymer having functional groups capable of three-dimensional crosslinking and functional groups capable of reacting with the oleophilic ingredient, and photoreaction initiator for initiating the three-dimensional crosslinking reaction of the hydrophilic binder polymer, and the hydrophilic binder polymer is three-dimensionally crosslinked by the post treating step.

8. The method of making an offset printing plate as defined in claim 5, wherein the heat sensitive layer contains microcapsules containing an oleophilic agent in the inside and destroyed thermally, hydrophilic binder polymer having functional groups capable of three-dimensional crosslinking and functional groups capable of reacting with the oleophilic ingredient, and photoreaction initiator for initiating the three-dimensional crosslinking reaction of the hydrophilic binder polymer, and the hydrophilic binder polymer is three-dimensionally crosslinked by the post treating step.

9. An apparatus for making an offset printing plate, comprising:

a cylinder having a rotational mechanism, a blank plate attaching mechanism for winding and securing a plate-shaped heat sensitive type blank plate to the outer circumferential surface of the cylinder, a cassette for keeping a plurality of blank plates, a blank plate supply mechanism for taking out the blank plates from the cassette and directing them to the cylinder, a laser generation device for generating a group of beams comprising a plurality of infrared laser beams arranged in line, a laser irradiation head having an optical system for focusing the group of beams comprising a plurality of laser beams irradiated from the laser generation device to a single area on the blank plate, an irradiation condition setting device for setting irradiation conditions on each of infrared laser beams based on an image forming signal and the position in the line such that the temperature of the blank plate is made uniform within the single area in which an image is formed at once by the group of beams in line, and a head moving mechanism for linearly moving the laser irradiation head along a line opposing in parallel with the rotational axis of the cylinder at a position spaced apart by a predetermined distance from the cylinder.

10. The apparatus for making an offset printing plate as defined in claim 9, wherein the blank plate supply mechanism comprises a conveying device for conveying the blank plate from the lateral direction to the cylinder, the blank plate attaching mechanism has a clamp mechanism for securing the top end of the blank plate conveyed by the conveying device to the circumferential surface of the cylinder, and the clamp mechanism has a positioning surface for being touched by the top end face of the blank plate.

11. The apparatus for making an offset printing plate as defined in claim 10, wherein the apparatus comprises a UV-ray irradiation device for irradiating UV-rays at a wavelength of 200 to 400 nm to the heat sensitive layer of the blank plate and a blank plate moving mechanism for detaching the blank plate from the cylinder and directing the same to the UV-ray irradiation device.

12. An apparatus for making an offset printing plate, comprising:

a cylinder of a structure capable of winding and securing a plate-shaped blank plate around the outer circumferential surface, a rotational mechanism for the cylinder, a laser generation device for generating a group of beams comprising a plurality of infrared laser beams arranged in line, a laser irradiation head having an optical system for focusing the group of beams comprising a plurality of laser beams irradiated from the laser generation device to a single area on the blank plate, an irradiation condition setting device for setting irradiation conditions on each of infrared laser beams based on an image forming signal and the position in the line such that the temperature of the blanket plate is made uniform within the single area in which an image is formed at once by the group of beams in line, a head moving mechanism for moving the irradiation head along with a line opposing in parallel with the rotational axis of the cylinder at a position spaced apart by a predetermined distance from the cylinder, a UV-ray irradiation device for irradiating UV-rays at a wavelength of 200 to 400 nm to the heat sensitive layer of the blank plate, and a blank plate moving mechanism for detaching the blank plate from the cylinder and the directing the same to the UV-ray irradiation device.

13. The method of making an offset printing plate as defined in claim 11, wherein the heat sensitive layer contains microcapsules containing an oleophilic agent in the inside and destroyed thermally, hydrophilic binder polymer having functional groups capable of three-dimensional crosslinking and functional groups capable of reacting with the oleophilic ingredient, and photoreaction initiator for initiating the three-dimensional crosslinking reaction of the hydrophilic binder polymer, and the hydrophilic binder polymer is three-dimensionally crosslinked by the post treating step.

14. The method of making an offset printing plate as defined in claim 12, wherein the heat sensitive layer contains microcapsules containing an oleophilic agent in the inside and destroyed thermally, hydrophilic binder polymer having functional groups capable of three-dimensional crosslinking and functional groups capable of reacting with the oleophilic ingredient, and photoreaction initiator for initiating the three-dimensional crosslinking reaction of the hydrophilic binder polymer, and the hydrophilic binder polymer is three-dimensionally crosslinked by the post treating step.

* * * * *